US006072441A

United States Patent [19]

Tanabe

[11] Patent Number: 6,072,441

[45] Date of Patent: Jun. 6, 2000

[54] METHOD OF PRODUCING A HELICAL ANTENNA AND THE HELICAL ANTENNA APPARATUS

[75] Inventor: Kosuke Tanabe, Tokyo, Japan

[73] Assignee: NEC Corporation, Tokyo, Japan

[21] Appl. No.: 09/185,587

[22] Filed: Nov. 4, 1998

[30] Foreign Application Priority Data

Nov. 6, 1997 [JP] Japan ..... 9-322160

[51] Int. Cl.[7] ..... H01Q 1/36

[52] U.S. Cl. ..... 343/895; 343/853; 343/700 MS

[58] Field of Search ..... 343/895, 702, 343/846, 829, 725, 853, 700 MS; H01Q 1/36

[56] References Cited

U.S. PATENT DOCUMENTS 5,198,831 3/1993 Burrell et al. ..... 343/895
5,346,300 9/1994 Yamamoto et al. ..... 343/895
5,706,019 1/1998 Darden, IV et al. ..... 343/895
5,828,348 10/1998 Tassoudji et al. ..... 343/895

*Primary Examiner*—Don Wong
*Assistant Examiner*—Shih-chao Chen
*Attorney, Agent, or Firm*—Young & Thompson

[57] ABSTRACT

A helical antenna capable of covering a plurality of frequency bands and using a common feeder system for antenna elements adjusted to the respective frequency bands. First and second antenna elements having lengths corresponding to wavelengths of the frequency bands to be used are arranged helically at a specified pitch angle and spaced apart in the circumferential direction of a cylindrical body on the surface of a dielectric sheet wound around the outer circumferential surface of the cylindrical body. Coupling lines to be electromagnetically coupled to one-side ends of the antenna elements being adjacent to one another are formed on the surface of the dielectric sheet. A signal is fed from a common feeder circuit through the coupling lines to the respective antenna elements.

32 Claims, 14 Drawing Sheets

METHOD OF PRODUCING A HELICAL ANTENNA AND THE HELICAL ANTENNA APPARATUS

BACKGROUND OF THE INVENTION

1. Field of the Invention

The present invention relates to a helical antenna used as an antenna for a mobile terminal in a mobile radio communication system or the like using a mobile satellite and to a method for producing the helical antenna.

2. Description of the Related Art

A mobile radio communication system using the mobile satellite in general uses a frequency band of 1.985 to 2.015 GHz as a transmission frequency band and a frequency band of 2.17 to 2.2 GHz as a reception frequency band.

In transmission and reception between the mobile satellite and a mobile station, therefore, an antenna having a frequency characteristic capable of effectively performing transmission and reception with a low return loss in a frequency band of about 30 MHz is required.

And a small-sized and lightweight antenna is necessary as an antenna for a mobile terminal.

Thus a helical antenna is used, but in case that such an antenna is made small-sized in axial length and in diameter, its transmission frequency band results in being narrow.

For example, a 4-wire wound helical antenna of about ¼ to ⅝ wavelengths in axial length and of about 0.1 wavelength in diameter can cover only such a very narrow frequency band as 1 to 2% of a frequency band to be used.

Due to this, such an antenna as this is unsuitable for an antenna using two different frequency bands, for example, a frequency band of 1.985 to 2.015 GHz and a frequency band of 2.17 to 2.2 GHz like an antenna used in a mobile radio communication system using a mobile satellite.

FIG. 14 is a characteristic diagram showing a relation between frequency and return loss in case that a helical antenna adjusted to a frequency band of 1.985 to 2.015 GHz is used in both frequency bands of 1.985 to 2.015 GHz and 2.17 to 2.2 GHz.

In FIG. 14, a Δ-mark 96 indicates a return loss at a frequency of 1.985 GHz and a Δ-mark 97 indicates a return loss at a frequency of 2.015 GHz.

And a Δ-mark 98 indicates a return loss at a frequency of 2.17 GHz and a Δ-mark 99 indicates a return loss at a frequency of 2.2 GHz.

As clearly known from FIG. 14, this antenna can cover transmission and reception in a frequency band of 1.985 to 2.015 GHz, but cannot cover transmission and reception in a frequency band of 2.17 to 2.2 GHz.

FIG. 15 is a structural diagram showing a conventional helical antenna capable of covering the above-mentioned two frequency bands and a feeder circuit of it.

In FIG. 15, an 8-wire wound antenna body 90 forming the helical antenna is flatly unrolled to be shown.

An 8-wire wound helical antenna capable of covering two frequency bands is formed by winding this antenna body 90 around the outer circumferential surface of a cylindrical body, not illustrated, made of a dielectric material of polycarbonate or the like.

The antenna body 90 is composed of a film 902 formed in the shape of a parallelogram out of a dielectric sheet made of polyimide or the like, first antenna elements 904 composed of conductive wires which extend on one surface of this film 902 in the long-side direction of said film 902 at a specified pitch angle and are arranged in parallel with one another at specified intervals in the short-side direction of said film 902, and second antenna elements 906 shorter than the first antenna elements 904.

The first antenna elements 904 and the second antenna elements 906 are arranged alternately with each other in the short-side direction of the film 902 in a state where their lower ends are arranged in a line.

In this case the first antenna elements 904 are adjusted in length to a frequency band of 1.985 to 2.015 GHz and the second antenna elements 906 are adjusted in length to a frequency band of 2.17 to 2.2 GHz.

The feeder circuit 92 is composed of a feeder system 94 of a first frequency band F1 (of 1.985 to 2.015 GHz) and a feeder system 96 of a second frequency band F2 (of 2.17 to 2.2 GHz).

The feeder system 94 of the first frequency band F1 is composed of a dividing/synthesizing circuit 941 which divides a high-frequency signal into two high-frequency signals being different by 180 degrees in phase from each other or synthesizes two high-frequency signals being different by 180 degrees in phase from each other into a high-frequency signal, a dividing/synthesizing circuit 942 which divides one high-frequency signal obtained by division performed by this dividing/synthesizing circuit 941 into two high-frequency signals (of 0 degree and −90 degrees) being different by 90 degrees in phase from each other to feed them to the antenna body 90 or synthesizes two high-frequency signals (of 0 degree and −90 degrees) being different by 90 degrees in phase from each other given from the antenna body 90 into a high-frequency signal, and a dividing/synthesizing circuit 943 which divides the other high-frequency power obtained by division performed by the dividing/synthesizing circuit 941 into two high-frequency signals (of −180 degrees and −270 degrees) being different by 90 degrees in phase from each other to feed them to the antenna body 90 or synthesizes two high-frequency signals (of −180 degrees and −270 degrees) being different by 90 degrees in phase from each other given from the antenna body 90 into a high-frequency signal.

Each of the input/output terminals of the dividing/synthesizing circuits 942 and 943 is connected with each of the first antenna elements 904 of the antenna body 90 through a coupling wire 944.

Number 945 indicates a connecting terminal to a transmission/reception system of the feeder system 94 of the first frequency band F1.

The feeder system 96 of the second frequency band F2 is composed of a dividing/synthesizing circuit 961 which divides a high-frequency signal into two high-frequency signals being different by 180 degrees in phase from each other or synthesizes two high-frequency signals being different by 180 degrees in phase from each other into a high-frequency signal, a dividing/synthesizing circuit 962 which divides one high-frequency signal obtained by division performed by this dividing/synthesizing circuit 961 into two high-frequency signals (of 0 degree and −90 degrees) being different by 90 degrees in phase from each other to feed them to the antenna body 90 or synthesizes two high-frequency signals (of 0 degree and −90 degrees) being different by 90 degrees in phase from each other given from the antenna body 90 into a high-frequency signal, and a dividing/synthesizing circuit 963 which divides the other high-frequency signal obtained by division performed by the dividing/synthesizing circuit 961 into two high-frequency signals (of −180 degrees and −270 degrees) being different by 90 degrees in phase from each other to feed them to the antenna body 90 or synthesizes two high-frequency signals (of −180 degrees and −270 degrees) being different by 90 degrees in phase from each other given from the antenna body 90 into a high-frequency signal.

Each of the input/output terminals of the dividing/synthesizing circuits 962 and 963 is connected with each of the second antenna elements 906 of the antenna body 90 through a coupling wire 964.

Number 965 indicates a connecting terminal to a transmission/reception system of the feeder system 96 of the second frequency band F2.

In a conventional helical antenna composed as described above, at the time of transmission, when a high-frequency signal of the first frequency band F1 is supplied from the transmission system to the terminal 945 of the feeder system 94, this high-frequency signal is divided by the dividing/synthesizing circuits 941, 942 and 943 into four high-frequency signals respectively having phase differences of 0, −90, −180 and −270 degrees to be fed to the respective first antenna elements 904 of the antenna body 90, and is radiated as radio-waves.

And when a high-frequency signal of the second frequency band F2 is supplied from the transmission system to the terminal 965 of the feeder system 96, this high-frequency signal is divided by the dividing/synthesizing circuits 961, 962 and 963 into four high-frequency signals respectively having phase differences of 0, −90, −180 and 270 degrees to be fed to the respective second antenna elements 905 of the antenna body 90, and is radiated as radio-waves.

On the other hand, among radio-waves receiving at the helical antenna, the radio-waves in the first frequency band F1 are caught by the first antenna elements 904 of the antenna body 90, and high-frequency powers generated in the first antenna elements 904 are synthesized in sequence by the dividing/synthesizing circuits 943, 942 and 941 and are supplied to the reception system through the terminal 945.

And among radio-waves receiving at the helical antenna, the radio-waves in the second frequency band F2 are caught by the second antenna elements 906 of the antenna body 90, and high-frequency powers generated in the second antenna elements 906 are synthesized in sequence by the dividing/synthesizing circuits 963, 962 and 961 and are supplied to the reception system through the terminal 965.

However, a conventional helical antenna has a structure where two sets of antenna elements, one of which sets comprises four conductive wires adjusted in length correspondingly to one of the two frequency bands and the other of which sets comprises four conductive wires adjusted in length correspondingly to the other of the two frequency band, are combined and these sets of antenna elements are provided with the respective feeder systems. As clearly known from FIG. 13 also, in order to cover the two frequency bands, six dividing/synthesizing circuits are needed in addition to two feeder connectors corresponding to the number of feeder systems and eight connecting points for the respective conductive wires of the helical antenna.

Therefore, since such feeder circuits can be mounted only two-dimensionally on a printed circuit board, the conventional helical antenna has some problems that the printed circuit board and the feeder circuit portion become large-sized, complicated and expensive.

And it is very difficult also to arrange eight connecting pins or the like for connecting respectively the conductive wires of the helical antenna and the dividing/synthesizing circuits with each other closely to the supporting board of the helical antenna.

SUMMARY OF THE INVENTION

The present invention has been performed in order to solve such a problem as described above, and an object of the present invention is to provide a helical antenna capable of covering a plurality of frequency bands and using common feeder systems for antenna elements adjusted to the respective frequency bands and provide a method for manufacturing the helical antenna.

In order to attain the above-mentioned object, the present invention is characterized by a helical antenna covering a plurality of different frequency bands, comprising;

- a single cylindrical body made of a dielectric material having a specified diameter and a specified length corresponding to wavelengths of said frequency bands,
- a plurality of antenna elements corresponding to the respective frequency bands, said antenna elements being formed by arranging alternately with one another a plurality of conductive wires adjusted in length to wavelengths of the respective frequency bands helically at a specified pitch angle with a spacing between each other on the outer circumferential surface of said cylindrical body in the circumferential direction of said cylindrical body, and a plurality of coupling lines each of which is electromagnetically coupled with said conductive wires, which are adjacent to each other and different in length from each other, of said respective antenna elements formed on said cylindrical body.

According to the present invention, it is possible to cover a plurality of frequency bands and use common feeder systems for antenna elements adjusted to the respective frequency bands.

And the present invention is characterized by a method for manufacturing a helical antenna covering a plurality of different frequency bands, comprising;

- a step of providing a cylindrical body made of a dielectric material having a specified diameter and a specified length corresponding to wavelengths of said frequency bands,
- a step of providing a dielectric sheet large enough to cover the outer circumferential surface of said cylindrical body,
- a step of forming a plurality of antenna elements by providing a plurality of conductive wires adjusted in length to wavelengths of the respective frequency bands with a spacing between each other and forming a plurality of coupling lines for electromagnetically coupling with each other one-side ends of said antenna elements which are adjacent to each other and are different in length from each other, and
- a step of winding said dielectric sheet which said plurality of antenna elements and said plurality of coupling lines are formed on around the outer circumferential surface of said cylindrical body.

According to the present invention, it is possible to form a plurality of antenna elements and a plurality of coupling lines in the same process and easily manufacture said helical antenna.

DETAILED DESCRIPTION OF THE PREFERRED EMBODIMENTS

A helical antenna according to the present invention is described together with a method for manufacturing the helical antenna with reference to FIGS. 1 to 13 in the following.

Figure 1:
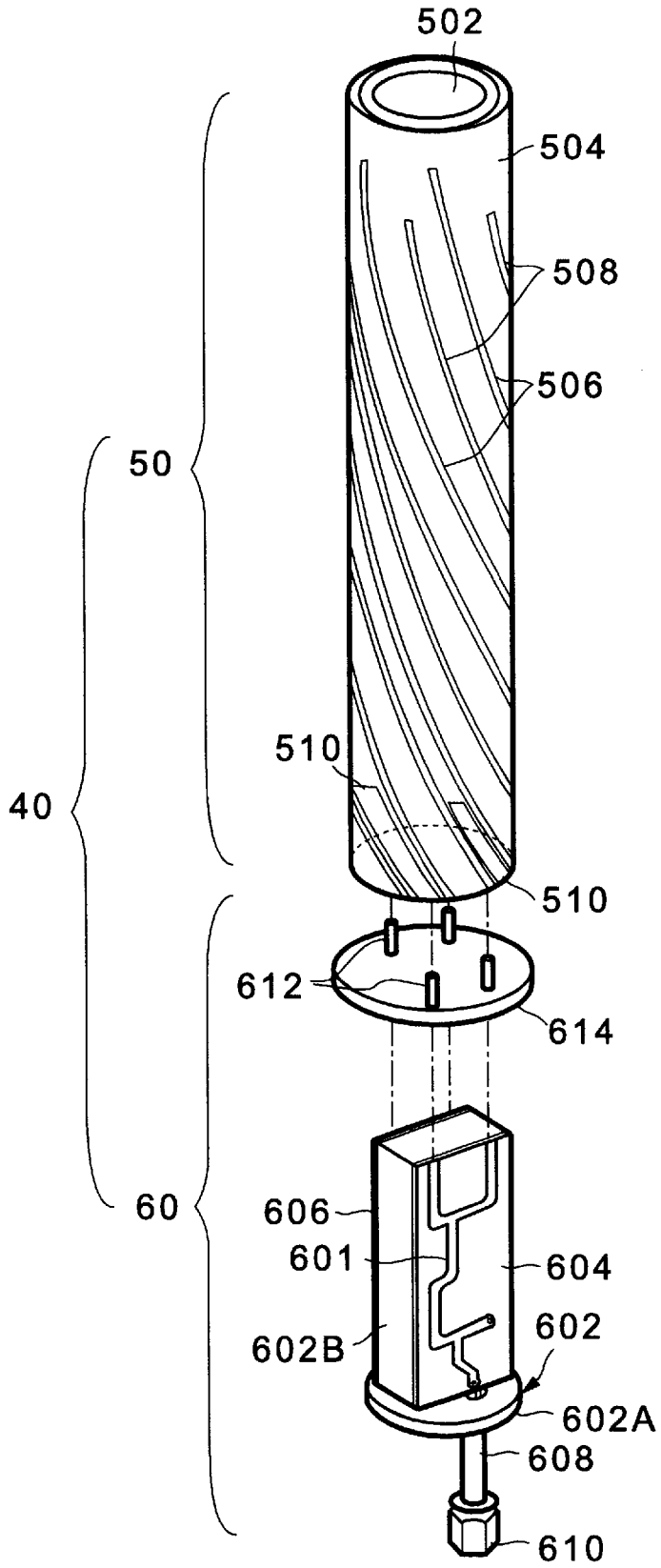
FIG. 1 is an exploded view in perspective of a helical antenna according to an embodiment of the present invention.
Figure 2:
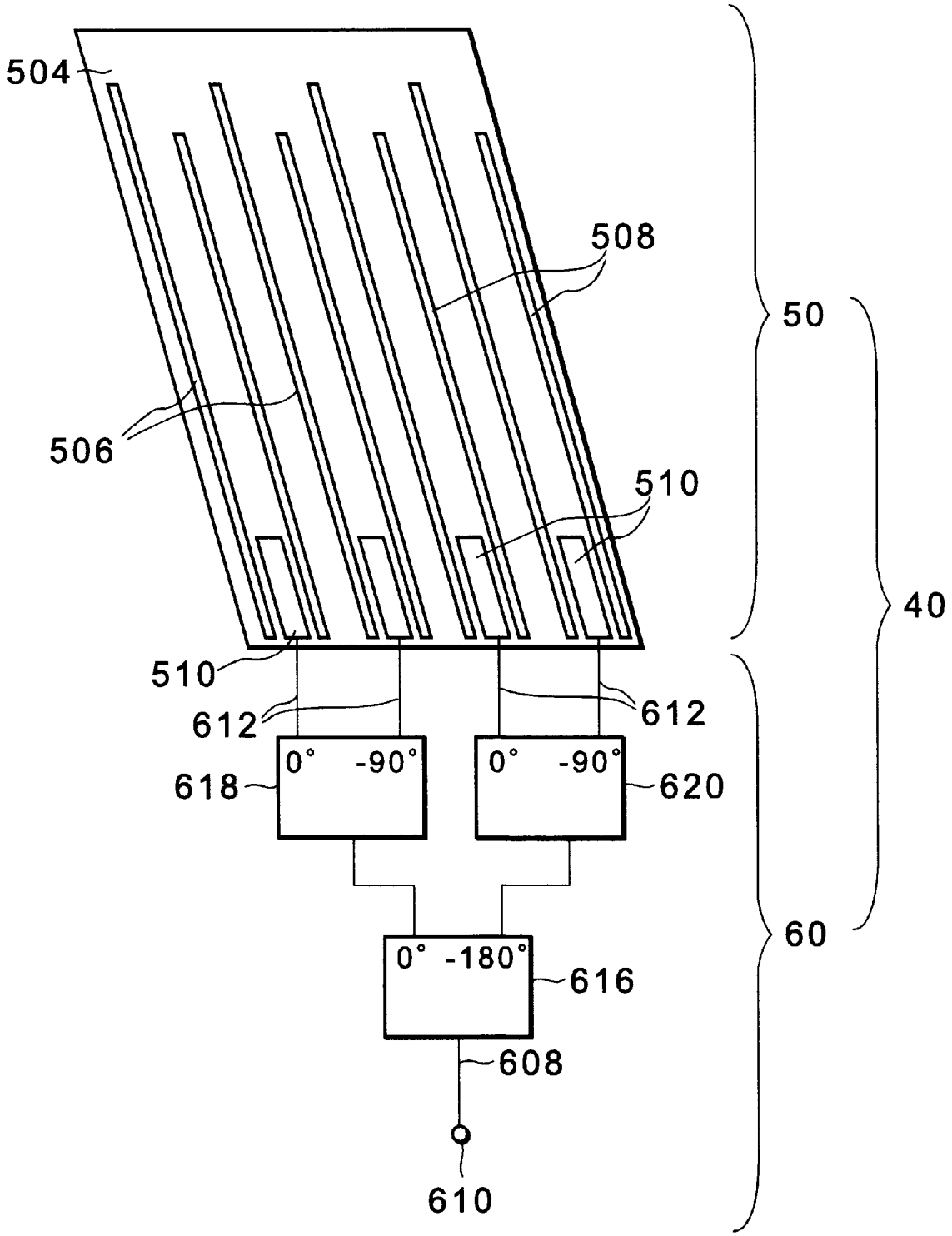
FIG. 2 is a structural Figure showing a state where an antenna body according to the embodiment of the present invention is flatly unrolled and a feeder circuit connected with said antenna.

FIG. 1 is an exploded view in perspective of a helical antenna of an embodiment according to the present invention, and FIG. 2 is a structural Figure showing a state where an antenna body is flatly unrolled and a feeder circuit connected with said antenna.

In FIGS. 1 and 2, a helical antenna 40 is provided with an antenna body 50 composed so that it can cover two frequency bands of a first frequency band F1 (of 1.985 to 2.015 GHz) and a second frequency band F2 (of 2.17 to 2.2 GHz), and a feeder circuit 60 commonly used by this antenna body 50.

As shown in FIGS. 1 and 2, said antenna body 50 is provided with a cylindrical body 502 having a diameter of about 8% of wavelength of the first frequency band F1 or the second frequency band F2 and a specified length and being made of a dielectric material such as polycarbonate, FRP or the like, and a dielectric sheet 504 formed out of polyimide or the like in the shape of a parallelogram, said dielectric sheet being wound around the outer circumferential surface of this cylindrical body 502.

On one surface of said dielectric sheet 504, as shown in FIG. 2, four first antenna elements 506 extending in the long-side direction of the dielectric sheet 502 at a pitch angle of about 69 degrees and four second antenna elements 508 shorter than said first antenna element 506 are arranged in parallel and alternately with one another at certain intervals in the short-side direction of the dielectric sheet 504 and the lower ends of the first antenna elements 506 and the second antenna elements 508 are arranged in a line.

The length of said first antenna elements 506 is about ¾ of wavelength of the first frequency band F1 and the length of said second antenna elements 508 is about ¾ of wavelength of the second frequency band F2.

Four coupling lines 510 each of which is electromagnetically coupled with one of the first antenna elements 506 and one of the second antenna elements 508 being adjacent to each other are formed at portions of the dielectric sheet 504 corresponding to the lower ends of the first antenna elements 506 and the second antenna elements 508.

The length of said coupling line 510 is about 14% of wavelength of the first frequency band F1 or the second frequency band F2.

The spacing between the coupling line 510 and the first antenna element 506 or the second antenna element 508 is about 1% of wavelength of the first frequency band F1 or the second frequency band F2.

The reason why the lengths of the first and second antenna elements 506 and 508 and the length of the coupling line 510 are set as said values is that a good impedance matching characteristics in the first and second frequency bands F1 and F2 and a wide radiation pattern characteristic (a wide directivity) in the vertex direction of the helical antenna can be obtained.

The first antenna elements 506, the second antenna elements 508 and the coupling lines 510 are formed at the same time in the same process by forming a copper foil layer in advance on the surface of the dielectric sheet 504 and etching this copper foil layer into an antenna element pattern shown in FIG. 2.

In FIG. 1, the feeder circuit 60 is provided with a base 602 made of aluminum having a disk 602A and a flat plate 602B provided perpendicularly to the upper surface of the disk 602A, two printed circuit boards 604 and 606 which are attached to both faces of the flat plate 602B and on which dividing/synthesizing circuit 601 composed of 3 dB hybrid circuits, microstrip lines and the like are mounted, a feeder coaxial cable 608 which is joined with the downside of the disk 602A of the base 602 and is connected with the printed circuit boards 604 and 606, and a connector 610 which is provided on the head end of the coaxial cable 608 and is to be connected with an unillustrated transmission and reception system.

Additionally, it is provided with a supporting plate 614 made of an electrically insulating material which plate supports the antenna body 50 and has four connecting pins 612 for connecting the coupling lines 510 of the antenna body 60 with the printed circuit boards 604 and 606.

These connecting pins 612 penetrate through the supporting plate 614 to project upward and downward, and the projecting ends of the connecting pins 612 are respectively connected by soldering to the coupling lines 510 of the antenna body 60 and the feeder terminals of the printed circuit boards 604 and 606.

In FIG. 2, the feeder circuit 60 is composed of a dividing/synthesizing circuit 616 which divides a high-frequency power of the first frequency band F1 (of 1.985 to 2.015 GHz) and the second frequency band F2 (of 2.17 to 2.2 GHz) into two high-frequency signals being different by 180 degrees in phase from each other or synthesizes two high-frequency signals being different by 180 degrees in phase from each other into a high-frequency signal, a dividing/synthesizing circuit 618 which divides one high-frequency signal obtained by division performed by this dividing/synthesizing circuit 616 into two high-frequency signals (of 0 degree and 90 degrees) being different by 90 degrees in phase from each other to feed them to the antenna body 50 or synthesizes two high-frequency signals (of 0 degree and −90 degrees) being different by 90 degrees in phase from each other given from the antenna body 50 into a high-frequency signal, and a dividing/synthesizing circuit 620 which divides the other high-frequency signal obtained by division performed by the dividing/synthesizing circuit 616 into two high-frequency signals (of −180 degrees and −270 degrees) being different by 90 degrees in phase from each other to feed them to the antenna body 50 or synthesizes two high-frequency signals (of −180 degrees and −270 degrees) being different by 90 degrees in phase from each other given from the antenna body 50 into a high-frequency signal.

Next, operation of a helical antenna composed as described above is described with reference to FIG. 2.

When a high-frequency signal of the first frequency band F1 (of 1.985 to 2.015 GHz) or the second frequency band F2 (of 2.17 to 2.2 GHz) is fed to the helical antenna through the connector 610, this high-frequency signal is transmitted through the cable 608 and is distributed by the dividing/synthesizing circuits 616, 618 and 620 mounted on the printed circuit boards 604 and 606 to the four connecting pins 612.

At this time the high-frequency signals distributed to the four connecting pins 612 are equal in amplitude to one another and are different by 90 degrees in phase from one another so as to be 0 degree, −90 degrees, −180 degrees and −270 degrees.

The high-frequency signals distributed into four are fed through the four electromagnetic coupling lines 510 to the antenna elements 506 and 508.

Hereupon, the high-frequency signals of the first frequency band F1 and the second frequency band F2 operate in different manners from each other.

That is to say, the high-frequency signal of the lower first frequency band F1 is transmitted to the longer first antenna elements 506, and radiates a high-frequency signal in its transmission process.

In a 4-wire type helical antenna of this kind, since a frequency characteristic of return loss is very narrow, its impedance is not matched with respect to the shorter second antenna elements 508 and the high-frequency signal is little transmitted to it.

For the lower first frequency band F1, therefore, only the longer first antenna elements 506 operate in such a manner as connected.

Similarly, the high-frequency signal of the higher second frequency band F2 is transmitted to only the shorter second antenna elements 508, and is little transmitted to the first antenna elements 506.

Among radio-waves received at the helical antenna 40, the radio-wave of the first frequency band F1 is caught by the first antenna elements 506 of the antenna body 50, and high-frequency signals generated in the first antenna elements 506 are synthesized in sequence by the dividing/synthesizing circuits 618, 620 and 616 and are fed through the cable 608 and the connector 610 to the reception system.

Among radio-waves receiving at the helical antenna 40, the radio-wave of the second frequency band F2 is caught by the second antenna elements 508 of the antenna body 50, and high-frequency signals generated in the second antenna elements 508 are synthesized in sequence by the dividing/synthesizing circuits 618, 620 and 616 and are fed through the cable 608 and the connector 610 to the reception system.

Figure 3:
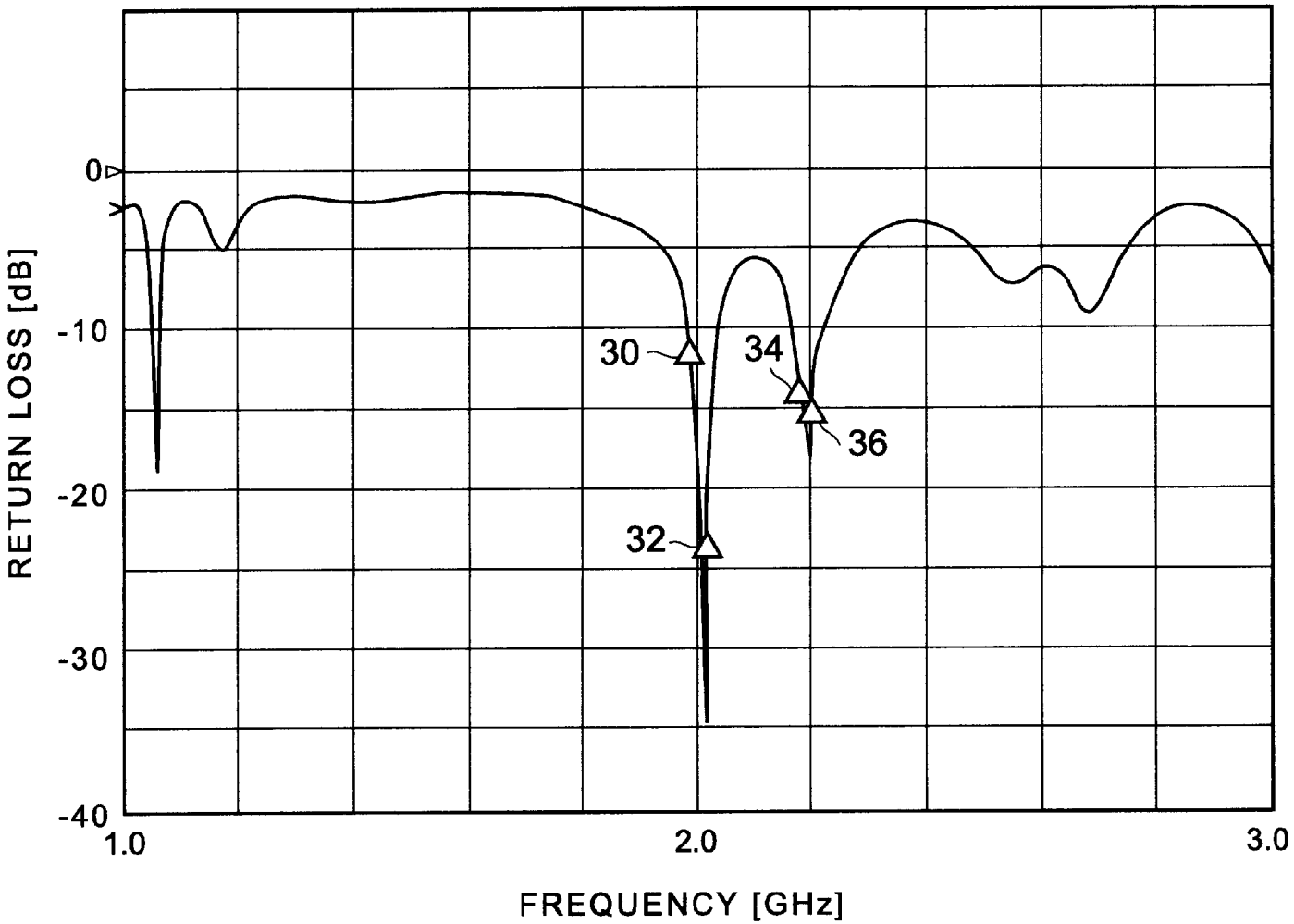
FIG. 3 is a graph showing a return loss characteristic obtained by seeing the antenna side from the electromagnetic coupling line side in the embodiment of the present invention.

FIG. 3 shows a return loss characteristic obtained by seeing the first and second antenna elements 506 and 508 sides from the electromagnetic coupling lines 510 side.

In FIG. 3, a Δ-mark 30 indicates a return loss at a frequency of 1.985 GHz and a Δ-mark 32 indicates a return loss at a frequency of 2.015 GHz.

And a Δ-mark 34 indicates a return loss at a frequency of 2.17 GHz and a Δ-mark 36 indicates a return loss at a frequency of 2.2 GHz.

As clearly known from FIG. 3, this antenna can cover transmission and reception in a frequency band of 1.985 to 2.015 GHz, and can also cover transmission and reception in a frequency band of 1.985 to 2.015 GHz.

Figure 4:
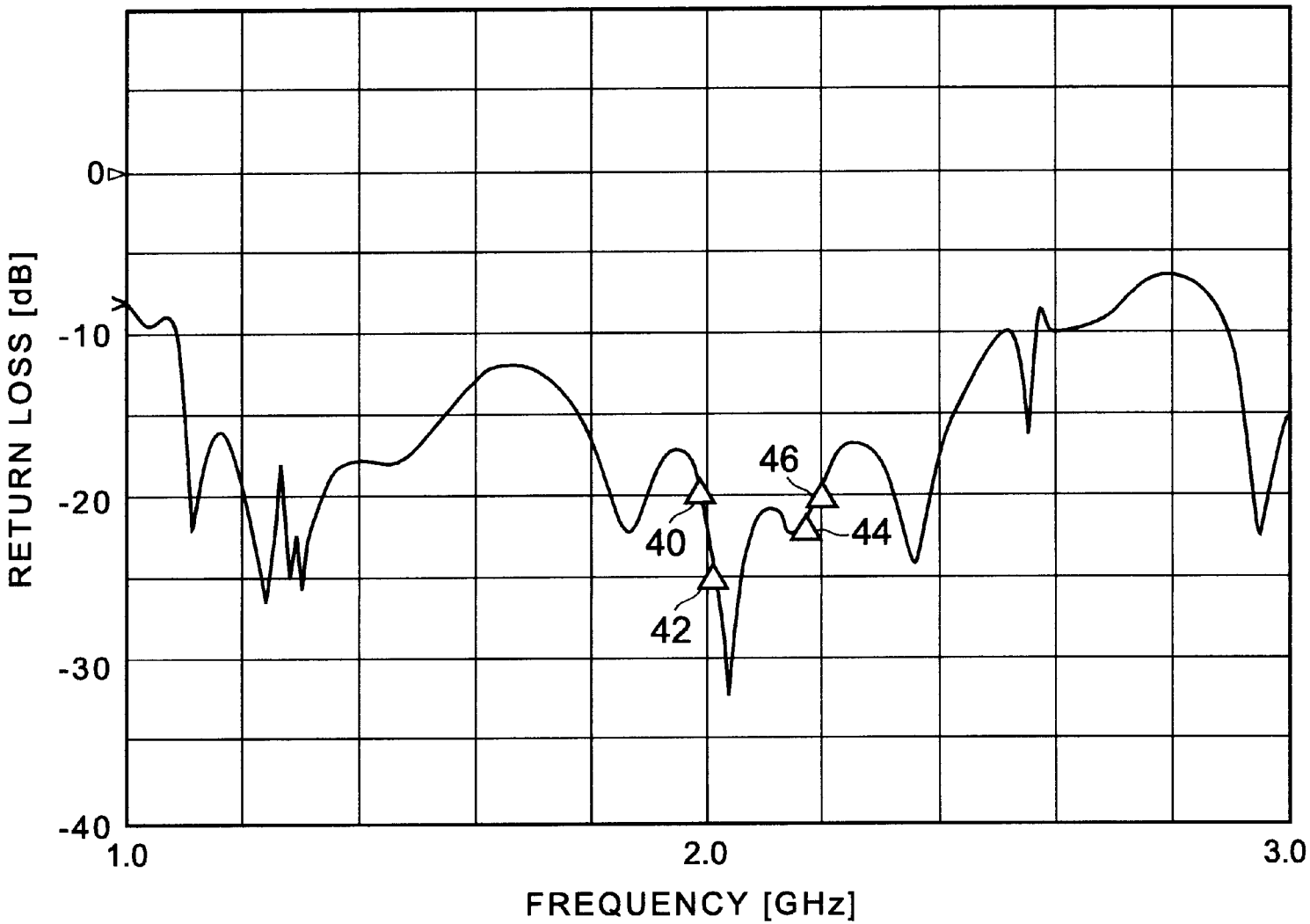
FIG. 4 is a graph showing a return loss characteristic obtained by seeing the antenna side from the connector side in the embodiment of the present invention.

FIG. 4 shows a return loss characteristic obtained by seeing the first and second antenna elements 506 and 508 sides from the connector 610 side.

In FIG. 4, a Δ-mark 40 indicates a return loss at a frequency of 1.985 GHz and a Δ-mark 42 indicates a return loss at a frequency of 2.015 GHz.

And a Δ-mark 44 indicates a return loss at a frequency of 2.17 GHz and a Δ-mark 46 indicates a return loss at a frequency of 2.2 GHz.

Figure 5:
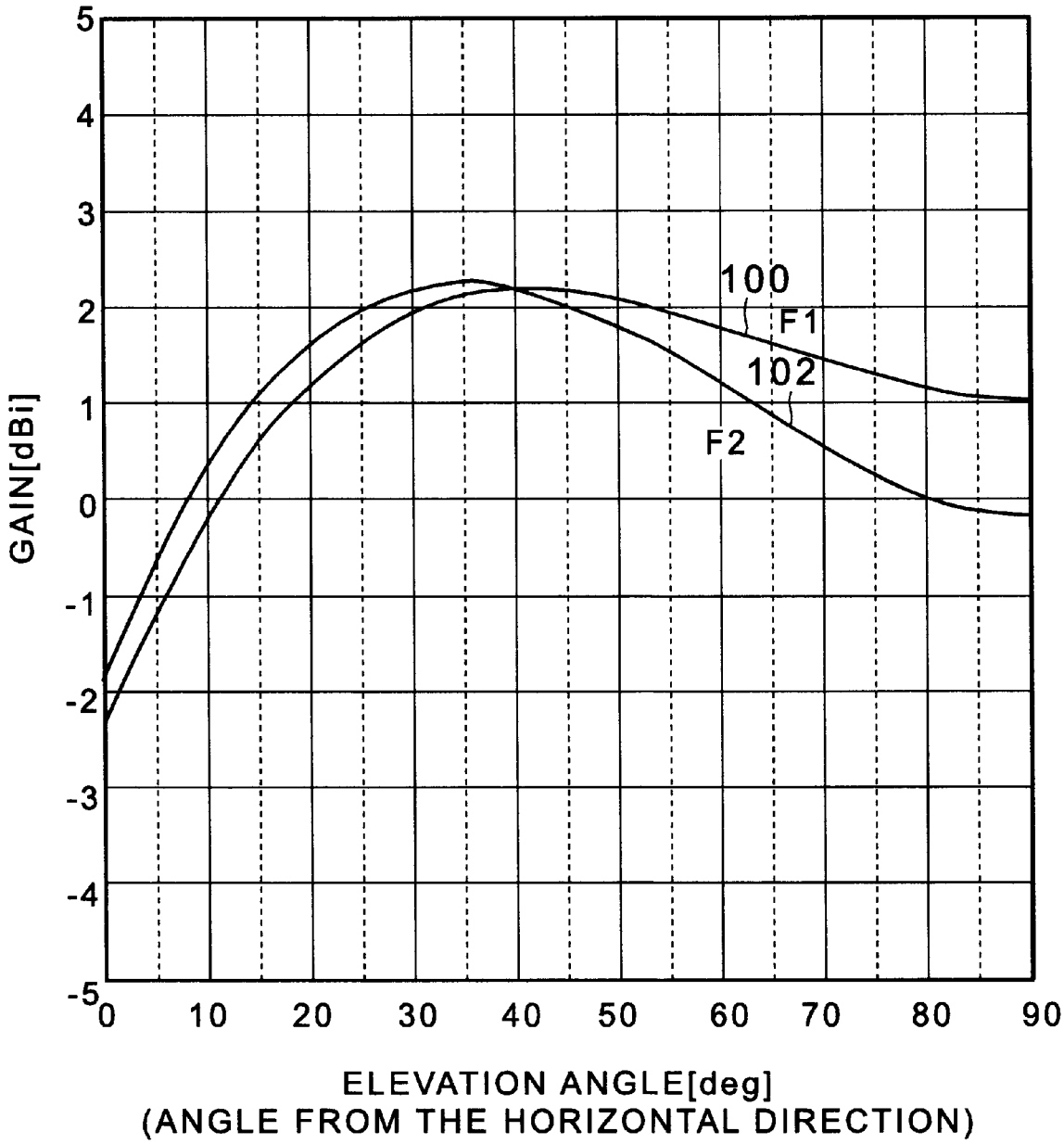
FIG. 5 is a graph showing an emission pattern characteristic of a high-frequency signal radiated from the helical antenna in the embodiment of the present invention.

FIG. 5 is a graph showing a radiation pattern characteristic of a high-frequency signal radiated from a helical antenna according to this embodiment, in which the abscissa shows an angle from the horizontal plane (elevation angle) and the ordinate shows the intensity of radio-waves.

In FIG. 5, curve 100 shows a radiation pattern characteristic of the first frequency band F1 and curve 102 shows a radiation pattern characteristic of the second frequency band F2.

As clearly known from FIG. 5, the helical antenna of this embodiment can cover the first frequency band F1 and the second frequency band F2. According to this embodiment as described above, it is possible to cover the first frequency band F1 and the second frequency band F2 and use the power feeding circuit 60 commonly to the first and second antenna elements 506 and 508 adjusted to the respective frequency bands by electromagnetically coupling one-side ends adjacent to each other of the sets of the first and second antenna elements 506 and 508 by means of the coupling lines 510.

Thus, the helical antenna can do with one feeder circuit 60, and also can do with one cable and one connector, and so the feeder circuit portion can be made small in size.

And according to the embodiment of the present invention, since the first and second antenna elements 506 and 508 and the coupling lines 510 can be formed at the same time by etching a copper foil on the surface of the dielectric sheet 504, such a helical antenna composed as described above can be easily manufactured.

FIGS. 6A to 6E are explanatory figures showing other embodiments of the structure of a coupling line 510 for coupling a feeder circuit 60 to first and second antenna elements according to the present invention.

Figures 6A, 6B, 6C, 6D, 6E:
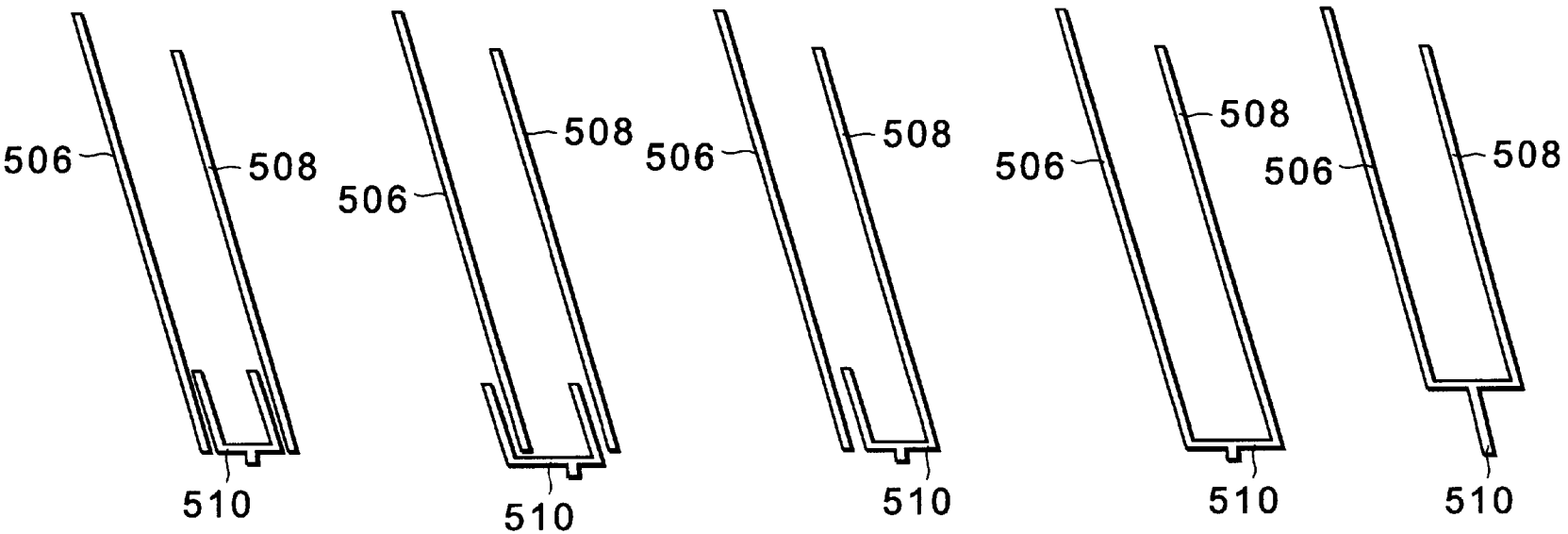
FIGS. 6A to 6E are explanatory figures showing other embodiments of a coupling line structure for coupling a feeder circuit to antenna elements according to the present invention.

FIG. 6A shows a structure which forms a coupling line 510 for coupling a first antenna element 506 and a second antenna element 508 to a feeder circuit 60 into a U shape having a spacing smaller than the spacing between the first and second antenna elements 506 and 508. One branch of this U-shaped coupling line 510 is electromagnetically coupled to one end portion of the first antenna element 506 with a gap between them, and the other branch is electromagnetically coupled to one end portion of the second antenna element 508 with a gap between them.

FIG. 6B shows a structure which forms a coupling line 510 for coupling a first antenna element 506 and a second antenna element 508 to a feeder circuit 60 into a U shape having a spacing equal to the spacing between the first and second antenna elements 506 and 508. One branch of this U-shaped coupling line 510 is electromagnetically coupled to one end portion of the first antenna element 506 with a gap between them, and the other branch is electromagnetically coupled to one end portion of the second antenna element 508 with a gap between them.

FIG. 6C shows a structure which forms a coupling line 510 for coupling a first antenna element 506 and a second antenna element 508 to a feeder circuit 60 into an L shape. One end of this coupling line 510 is joined directly to one end of the second antenna element 508, and the other end of this coupling line 510 is electromagnetically coupled to one end portion of the first antenna element 506 with a gap between them.

FIG. 6D shows a structure which forms a coupling line 510 for coupling a first antenna element 506 and a second antenna element 508 to a feeder circuit 60 so as to be electrically directly connected with one-side ends of the first and second antenna elements 506 and 508.

FIG. 6E shows a structure which is the same as the structure of FIG. 6D except for having a long coupling line at the center of the coupling line 510.

The coupling lines in these embodiments can be formed on the same surface as the surface of the dielectric sheet on which the antenna elements are formed. Therefore, these embodiments have an advantage providing an easy frequency adjustment by cutting a pattern of the elements or the line.

FIGS. 7A to 7E are explanatory figures showing further embodiments of the structure of a coupling line 510 for coupling first and second antenna elements to a feeder circuit 60 according to the present invention.

Figures 7A, 7B, 7C, 7D, 7E:
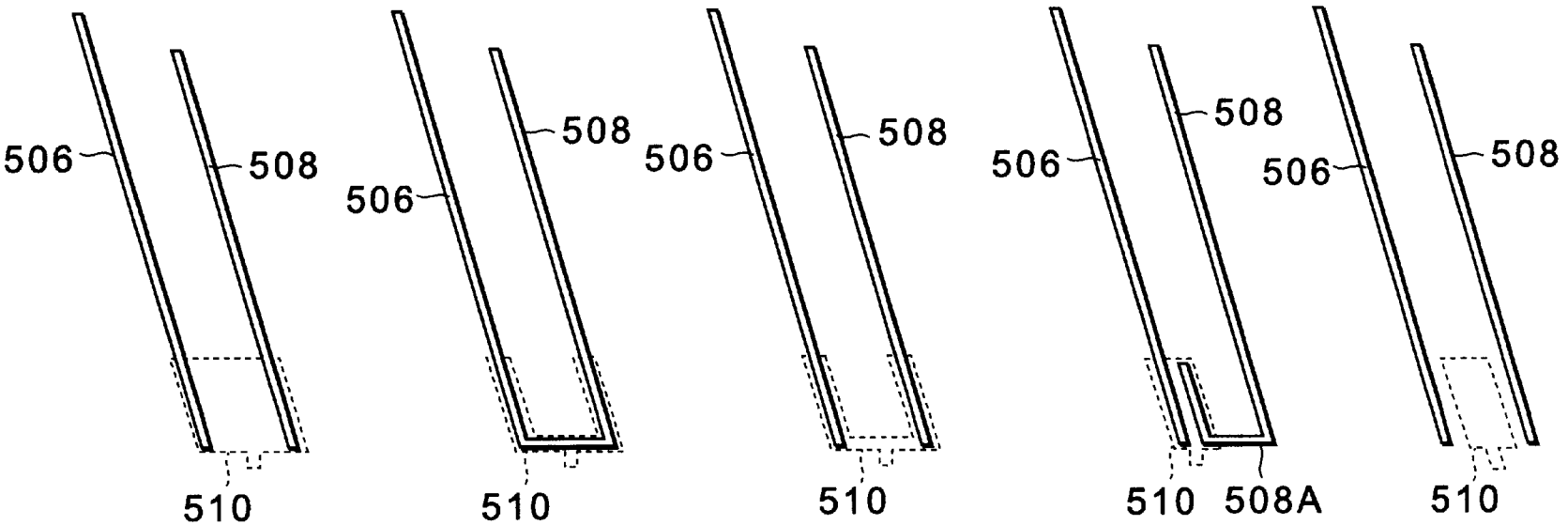
FIGS. 7A to 7E are explanatory figures showing further other embodiments of a coupling line structure for coupling a feeder circuit to antenna elements according to the present invention.

FIG. 7A shows a structure which forms a coupling line 510 for coupling a first antenna element 506 and a second antenna element 508 to a feeder circuit 60 on the surface opposite to the surface of a dielectric sheet on which the first and second antenna elements 506 and 508 are formed, so as to be opposite to the first and second antenna elements 506 and 508, as shown by a dashed line, and thereby couples the coupling line 510 electromagnetically with the first and second antenna elements 506 and 508.

FIG. 7B shows a structure which joins with each other one-side ends of a first antenna element 506 and a second antenna element 508, forms a coupling line 510 for coupling the first antenna element 506 and the second antenna element 508 to a feeder circuit 60 into a U shape having a spacing equal to the spacing between the first and second antenna elements 506 and 508 and on the surface opposite to the surface of a dielectric sheet on which the first and second antenna elements 506 and 508 are formed, so as to be opposite to the first and second antenna elements 506 and 508, as shown by a dashed line, and thereby couples the coupling line 510 electromagnetically with the first and second antenna elements 506 and 508.

FIG. 7C shows a structure which forms a coupling line 510 for coupling a first antenna element 506 and a second antenna element 508 to a feeder circuit 60 into a U shape having a spacing equal to the spacing between the first and second antenna elements 506 and 508, as shown by a dashed line, and on the surface opposite to the surface of a dielectric sheet on which the first and second antenna elements 506 and 508 are formed, so as to be opposite to the first and second antenna elements 506 and 508, and thereby couples the coupling line 510 electromagnetically with the first and second antenna elements 506 and 508.

FIG. 7D shows a structure which forms one end portion 508A of the second antenna element 508 into an L shape and makes the one end portion 508A close to one end of the first antenna element 506, and forms a coupling line 510 for coupling the first and second antenna elements 506 and 508 to a feeder circuit, as shown by a dashed line, on the surface opposite to the surface of a dielectric sheet on which the first and second antenna elements 506 and 508 are formed, so as to be opposite to the one end portion of the first antenna element 506 and the L-shaped one end portion 508A, and couples the coupling line 510 electromagnetically with the first and second antenna elements 506 and 508.

FIG. 7E shows the same structure as the structure shown in FIG. 7A except for that the coupling line 510 is adjacent to the antenna elements 506 and 508.

Figure 8:
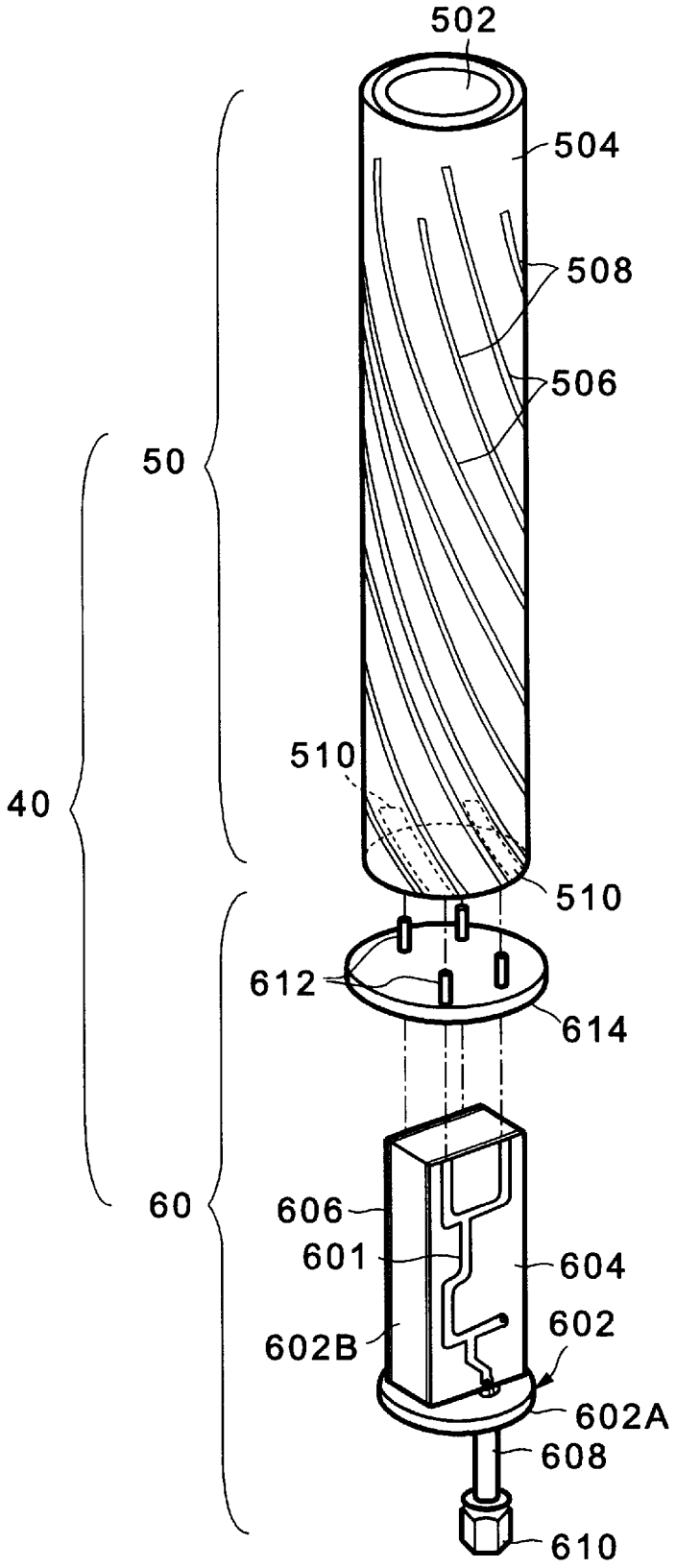
FIG. 8 is an exploded view in perspective of a helical antenna according to other embodiment of the present invention.

FIG. 8 shows other embodiment of the helical antenna. FIG. 8 is the same structure as the structure shown in FIG. 1 except for that the coupling line structure is the structure shown in FIG. 7E.

Figure 9:
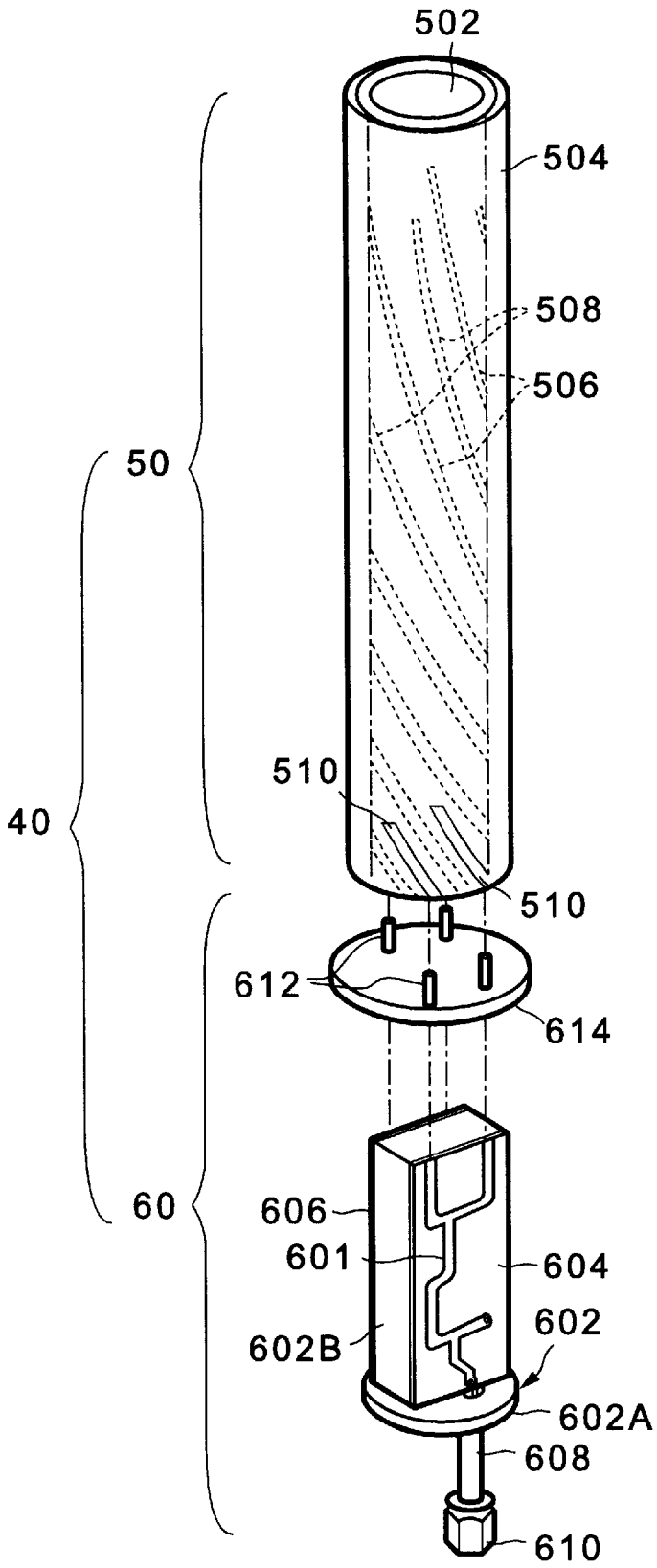
FIG. 9 is an exploded view in perspective of a helical antenna according to further other embodiment of the present invention.

FIG. 9 shows further other embodiment of the helical antenna. FIG. 9 is the same structure as the structure shown in FIG. 1 except for that the coupling lines 510 are formed on the outer surface of the cylindrical body 502 and the antenna elements 508, 506 are formed on the inner surface of the cylindrical body 502.

Figure 10:
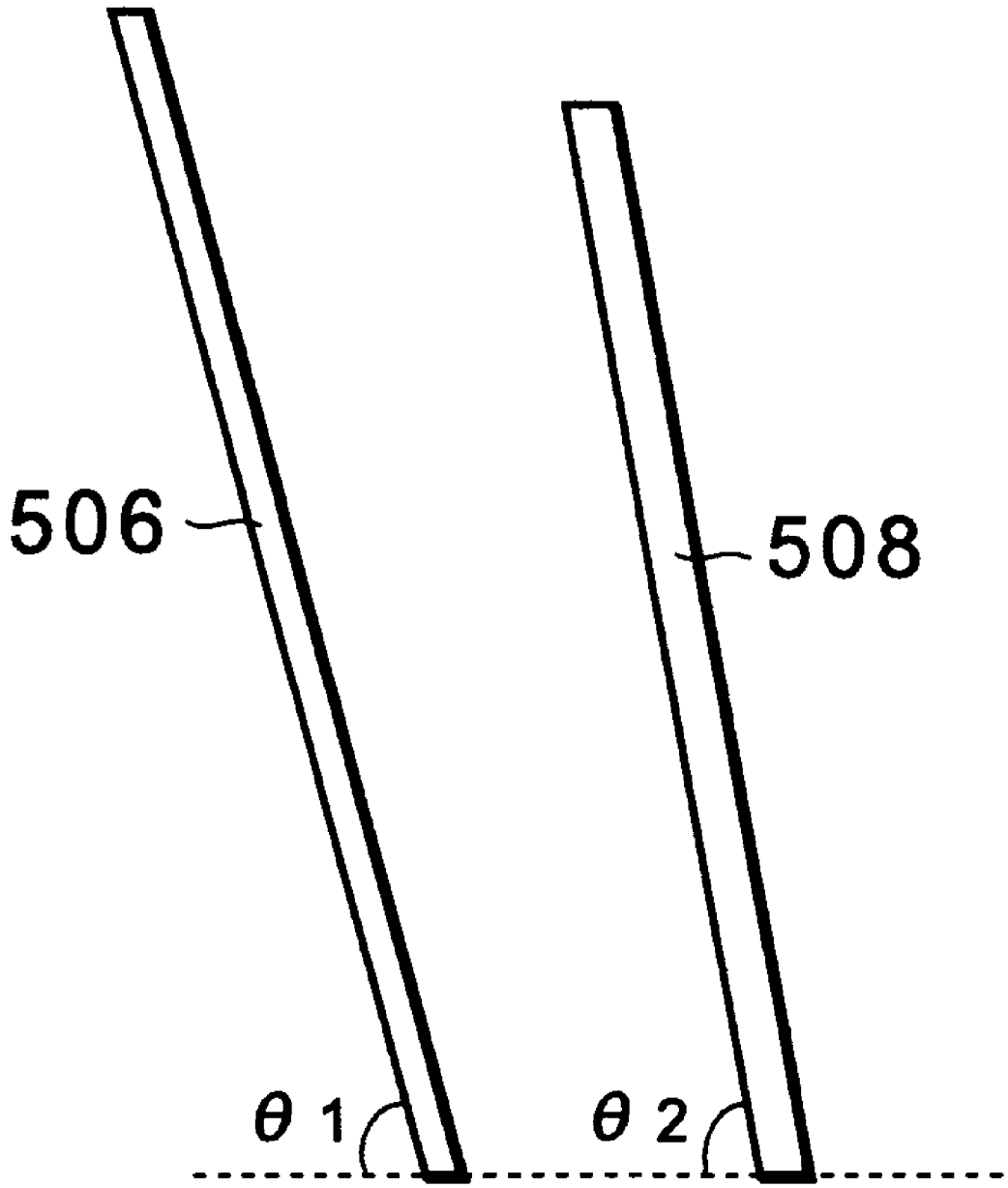
FIG. 10 is a structural figure showing another embodiment of an antenna element according to the present invention.

FIG. 10 is explanatory figure showing other embodiment of the structure of first antenna elements 506 and second antenna elements 508 according to the present invention. The first antenna elements 506 and the second antenna elements 508 are arranged in parallel at same fixed pitch angle as shown in FIGS. 1, 2, 6A to 6E and 7A to 7E. However, the first antenna elements 506 and the second antenna elements 508 in FIG. 10 are not arranged in parallel at the same pitch angle. As shown in FIG. 10, the first antenna elements 506 have an incline angle of $\theta 1$ degree from a horizontal line (the edge of the dielectric sheet 504). The second antenna elements 508 have an incline angle of $\theta 2$ degree from the horizontal line. The $\theta 1$ and $\theta 2$ are selected so that the first antenna elements 506 and the second antenna elements 508 do not cross respectively. A pitch angle of the helical antenna, formed by winding this antenna body with these antenna elements around the cylindrical body, is changeable by changing the $\theta 1$ and $\theta 2$. Therefore, when a beam tilt between the transmission frequency band and the reception frequency band is occurred in case of a parallel arrangement of the antenna elements, the beam tilt of the helical antenna is compensated by changing the $\theta 1$ and $\theta 2$.

Figure 11A:
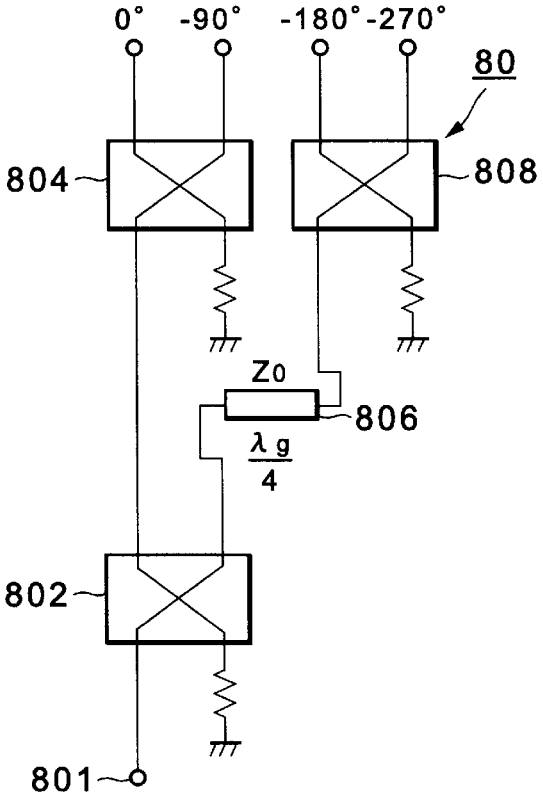
FIGS. 11A and 11B are embodiment showing a feeder circuit according to the present invention.
Figure 11B:
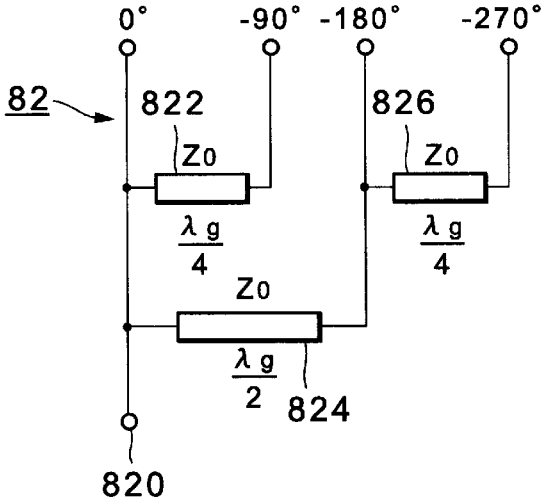

FIGS. 11A and 11B are compositional diagrams showing embodiments of a feeder circuit 60 shown in FIG. 2.

In FIG. 11A, a dividing/synthesizing circuit 80 forming a feeder circuit 60 is composed of a first 3-dB hybrid circuit 802 to be connected to a feeder terminal 801, a second 3-dB hybrid circuit 804 which is connected to one output terminal of this hybrid circuit 802 and divides a high-frequency signal into two high-frequency signals (of 0 degree and −90 degrees) or synthesizes them into a high-frequency signal, and a third 3-dB hybrid circuit 808 which is connected through a ¼-wavelength line 806 of impedance Z0 to the other output terminal of the first 3-dB hybrid circuit 802 and divides a high-frequency signal into two high-frequency signals (of −180 degrees and −270 degrees) or synthesizes them into a high-frequency signal.

In FIG. 11B, a dividing/synthesizing circuit 82 forming a feeder circuit 60 is composed of a ¼-wavelength line 822 of impedance Z0 which is connected with a feeder terminal 820 and divides a high-frequency signal into two high-frequency signals of 0 degree and −90 degrees in phase or synthesizes them into a high-frequency signal, a ½-wavelength λg line 824 of impedance Z0 which is connected to the feeder terminal 820 and divides a high-frequency signal into two high-frequency signals of 0 degree and −180 degrees in phase or synthesizes them into a high-frequency signal, and a ¼-wavelength λg line 826 of impedance Z0 which divides a high-frequency signal given from the ½-wavelength line 824 into two high-frequency signals of −180 degrees and −270 degrees in phase or synthesizes them into a high-frequency signal.

Also in case of incorporating such a dividing/synthesizing circuit 80 or 82 into a helical antenna 40, the same action and effect as the case shown in FIG. 2 can be obtained.

Figure 12:
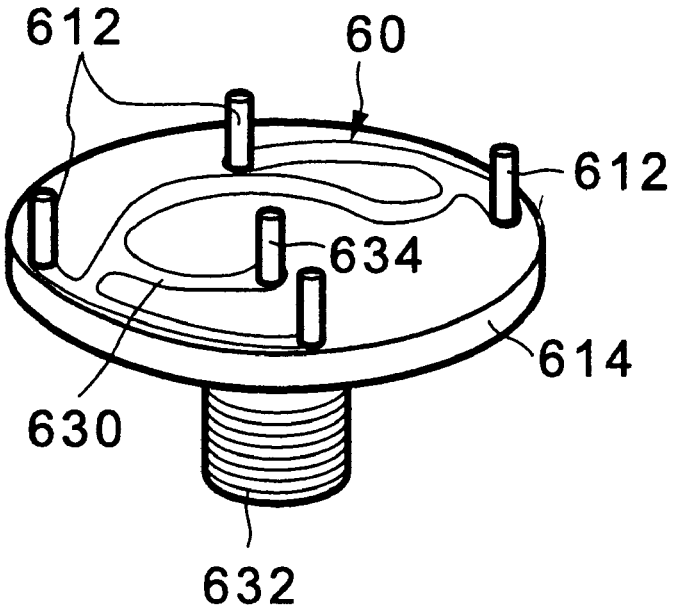
FIG. 12 is a perspective view showing other embodiment showing a feeder circuit according to the present invention on a supporting plate of a helical antenna.
Figure 13:
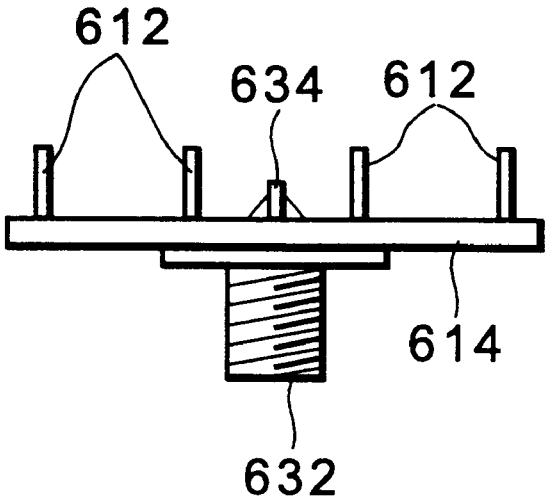
FIG. 13 is a side view of FIG. 12.
Figure 14:
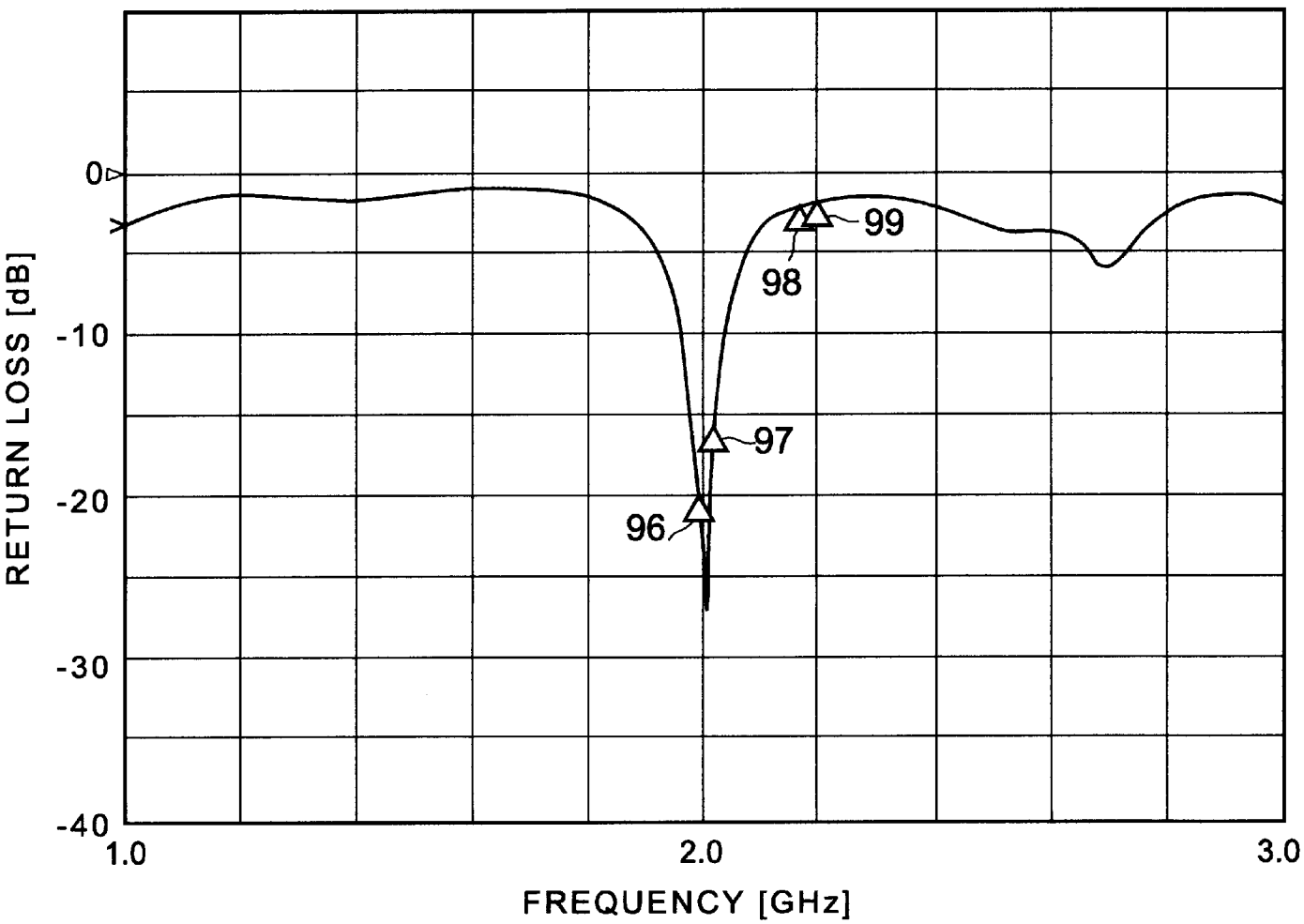
Fig.14 PRIOR ART
FIG. 14 is a characteristic diagram showing a relation between frequency and return loss of a helical antenna according to the prior art.
Figure 15:
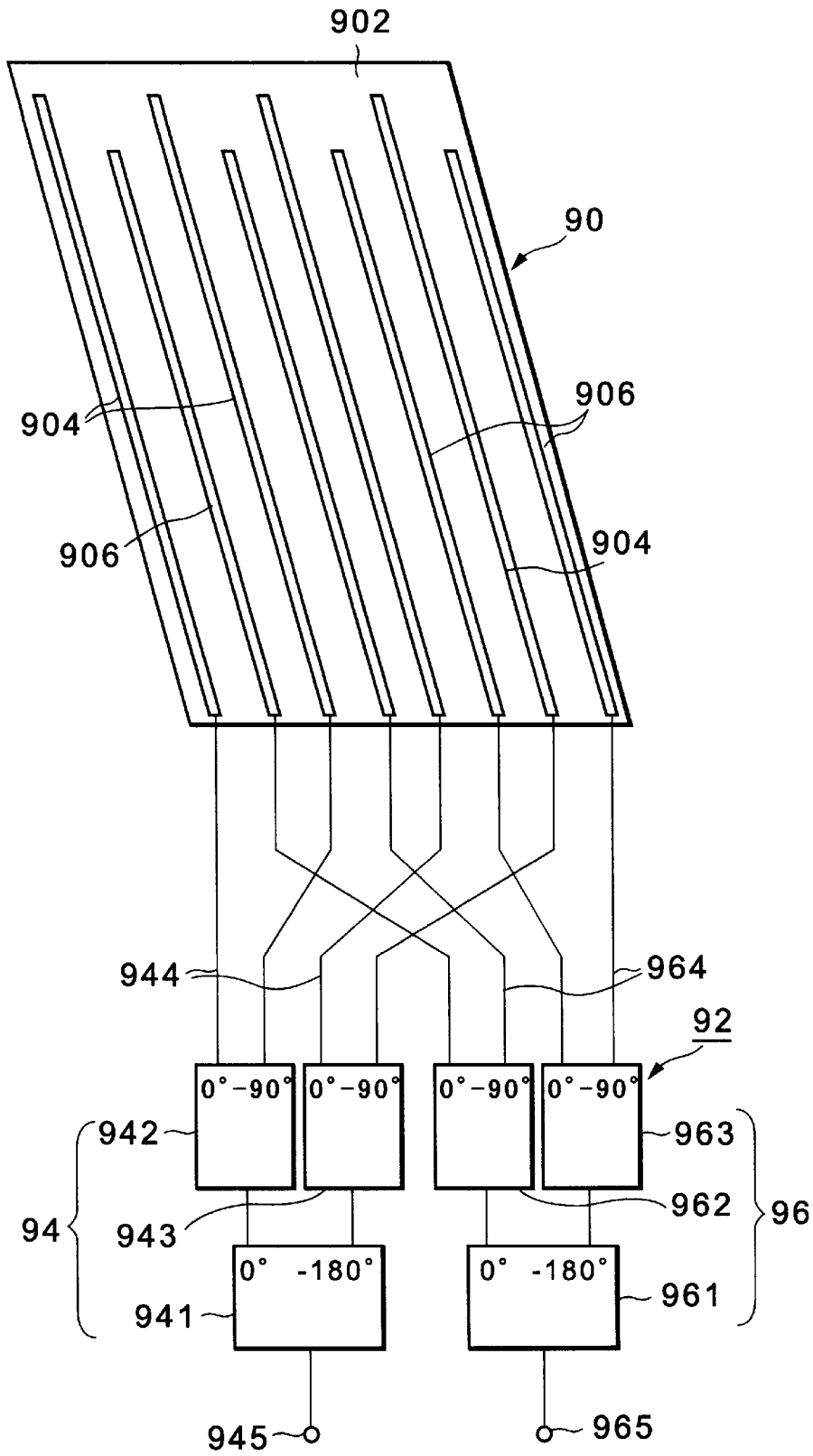
Fig.15 PRIOR ART
FIG. 15 is a structural Figure showing a helical antenna and its feeder circuit according to the prior art.

Next, with reference to FIGS. 12 and 13, other embodiment of the present invention in case of forming a feeder circuit 60 on a supporting plate of a helical antenna is described.

In FIGS. 12 and 13, a feeder circuit 60 formed by combining a plurality of microstrip lines 630 of fractions of wavelength of a frequency band to be used is formed on the surface of a supporting plate 614 of a helical antenna.

As shown in FIG. 1, the microstrip lines 630 of the feeder circuit 60 are connected to a plurality of connecting pins 612 being provided on and projecting from the places of the supporting plate 614, said places being opposite to the respective coupling lines 510 of the antenna body 50.

And a connector 632 for feeding power to the feeder circuit 60 is fixed on the middle of the reverse surface of the supporting plate 614, and a connecting pin 634 which penetrates through the supporting plate 614 from the connector 632 to project from the surface of the supporting plate 614 is connected to the microstrip line 630 of the feeder circuit 60.

The microstrip lines having a pattern shown in FIG. 12 are formed by adopting a method of forming in advance a copper foil on the surface of the supporting plate 614 and etching this copper foil as a method for forming said microstrip lines 630 of the feeder circuit 60.

And as another method it is possible also to form the microstrip lines 630 of a pattern shown in FIG. 10 on the surface of the supporting plate 614 by means of printing.

In a helical antenna having such a composition as described above, the base 602, the printed circuit boards 604 and 606, and the cable 608 shown in FIG. 1 can be omitted, the length of the whole helical antenna can be shortened, and the number of components of the helical antenna can be reduced, and thereby the helical antenna can be easily made smaller in size and lower in cost.

In the above-mentioned embodiments, although a helical antenna covering two frequency bands of a first frequency band F1 and a second frequency band F2 in a mobile radio communication system using a satellite, the present invention is not limited to this, but can be applied also to a helical antenna covering three or more frequency bands to be used in a similar way to said case of applying the invention to two frequency bands although the number of kinds of antenna elements being different in length from one another is increased correspondingly to the frequency bands to be used.

As described above, according to a helical antenna of the present invention, it is possible to cover a plurality of frequency bands and commonly use a feeder circuit for antenna elements corresponding to the respective frequency bands by coupling the respective sets of antenna elements corresponding to the respective wavelengths electromagnetically with the feeder circuit by means of coupling lines.

By this, the helical antenna can do with one feeder circuit and can do also with one cable and one connector, and therefore can have the feeder circuit portion made smaller in size.

And according to a helical antenna of the present invention, it is possible to easily reduce the number of components of the helical antenna and make the helical antenna smaller in size and lower in cost.

And according to a helical antenna manufacturing method of the present invention, it is possible to easily manufacture such a helical antenna as described above.

What is claimed is:

1. A helical antenna covering a plurality of different frequency bands, comprising;

a cylindrical body;

a plurality of antenna elements that have a plurality of different lengths that are based on the wavelengths of the plurality of different frequency bands and that are arranged alternately in sets of the antenna elements at a specified pitch angle on the surface of said cylindrical body;

a plurality of coupling lines that are each capacitively coupled with each of the antenna elements in a respective one of said sets of antenna elements; and a feeder circuit that is connected to all of said plurality of coupling lines and that has a common input/output port for conveying all signals of different frequency bands that are received and transmitted by said plurality of antenna elements.

2. The helical antenna as defined in claim 1, wherein a dielectric sheet is wound around the outer circumferential surface of said cylindrical body, and said plurality of antenna elements and said plurality of coupling lines are formed on said dielectric sheet.

3. The helical antenna as defined in claim 1, wherein the length of said coupling lines is set according to the wavelength of one of the plurality of different frequency bands.

4. The helical antenna as defined in claim 1, wherein said coupling lines are formed on the same surface as the surface of the dielectric sheet on which said antenna elements are formed.

5. The helical antenna as defined in claim 1, wherein said coupling lines are formed on the opposite surface to the surface of the dielectric sheet on which said antenna elements are formed.

6. The helical antenna as defined in claim 1, wherein said cylindrical body including said antenna elements is supported by a supporting plate, and said feeder circuit and said coupling lines are connected with each other through connecting pins provided on said supporting plate.

7. The helical antenna as defined in claim 6, wherein said supporting plate is disposed at an end in the longitudinal direction of said cylindrical body.

8. The helical antenna as defined in claim 7, wherein a printed circuit board is disposed on the surface opposite to the surface of said supporting plate facing said cylindrical body and said feeder circuit is mounted on said printed circuit board.

9. The helical antenna as defined in claim 8, wherein said connecting pins penetrating through said supporting plate are provided across between the cylindrical body and the printed circuit board.

10. The helical antenna as defined in claim 8, wherein said printed circuit board is supported by a base.

11. The helical antenna as defined in claim 10, wherein a cable for feeding signal to said feeder circuit is provided on said base.

12. The helical antenna as defined in claim 11, wherein said cable is provided with a connector.

13. The helical antenna as defined in claim 1, wherein said feeder circuit is composed of a plurality of dividing/synthesizing circuits each of which divides a high-frequency signal into high-frequency signals having specified phases corresponding to the number of conductive wires forming said antenna elements or synthesizes the high-frequency signals.

14. The helical antenna as defined in claim 13, wherein said dividing/synthesizing circuit is composed by combining a hybrid circuit and a microstrip line corresponding to a fraction of wavelength of a frequency band to be used.

15. The helical antenna as defined in claim 13, wherein said dividing/synthesizing circuit is composed by combining a plurality of microstrip lines each of which corresponds to a fraction of wavelength of a frequency band to be used.

16. The helical antenna as defined in claim 1, wherein said cylindrical body including said antenna-elements is supported by a supporting plate, said feeder circuit is formed on said supporting plate, and said feeder circuit and said coupling lines are connected with each other through said connecting pins provided in the supporting plate.

17. The helical antenna as defined in claim 16, wherein said supporting plate is provided with a connector for feeding signal to said feeder circuit.

18. The helical antenna as defined in claim 16, wherein said feeder circuit is composed by combining a plurality of wavelength lines each of which corresponds to a fraction of wavelength of a frequency band to be used.

19. A method for manufacturing a helical antenna covering a plurality of different frequency bands, comprising the steps of;

providing a cylindrical body;

providing a dielectric sheet large enough to cover the surface of said cylindrical body;

forming on said dielectric sheet a plurality of antenna elements that have a plurality of different lengths that are based on the wavelengths of the plurality of different frequency bands, that are arranged alternately in sets at a specified pitch angle on the surface of said cylindrical body;

forming a plurality of coupling lines that are each capacitively coupled with each of the antenna elements in a respective one of said sets of said antenna elements;

winding said dielectric sheet which said plurality of antenna elements and said plurality of coupling lines are formed on around the surface of said cylindrical body; and providing a feeder circuit that is connected to all of said plurality of coupling lines and that has a common input/output port for conveying all signals of different frequency bands that are received and transmitted by said plurality of antenna elements.

20. The method for manufacturing a helical antenna as defined in claim 19, wherein said plurality of antenna elements and said plurality of coupling lines are formed on the surface of said dielectric sheet in a state where said dielectric sheet is flatly unrolled.

21. The method for manufacturing a helical antenna as defined in claim 19, wherein said dielectric sheet is formed in the shape of a parallelogram in a state where it is flatly unrolled so that said dielectric sheet can be wound around said cylindrical body at said specified pitch angle.

22. The method for manufacturing a helical antenna as defined in claim 21, wherein said plurality of antenna elements are linearly formed in parallel with the long sides of said parallelogram and with a spacing between each other.

23. The method for manufacturing a helical antenna as defined in claim 19, wherein said dielectric sheet has a copper foil on the surface of it and said plurality of antenna elements and said plurality of coupling lines are formed by etching said copper foil.

24. The method for manufacturing a helical antenna as defined in claim 19, wherein said plurality of antenna elements and said plurality of coupling lines are formed by printing on the surface of said dielectric sheet.

25. A helical antenna covering a plurality of different frequency bands, comprising;

a cylindrical body;

a plurality of antenna elements, which have different lengths based on wavelengths of said different frequency bands, arranged alternately in sets at a specified pitch angle on the surface of said cylindrical body;

a plurality of coupling lines that are each connected directly to each of the antenna elements in a respective one of said sets of antenna elements; and a feeder circuit that is connected to all of said plurality of coupling lines and that has a common input/output port for conveying all signals of different frequency bands that are received and transmitted by said plurality of antenna elements.

26. A helical antenna for covering a first frequency and a second frequency that is different from the first frequency, the antenna comprising:

a cylindrical surface;

plural first antenna elements on said surface that each have a first length that is a function of a wavelength of the first frequency;

plural second antenna elements on said surface that each have a second length different from the first length and that is a function of a wavelength of the second frequency;

plural coupling lines that each are capacitively coupled with one of said first antenna elements and one of said second antenna elements and that each electromagnetically couple a different one of said first antenna elements to a different one of said second antenna elements; and a feeder circuit that is connected to all of said plural coupling lines and that has a common input/output port for conveying all signals of the first and second frequencies that are received and transmitted by said first and second antenna elements.

27. The antenna of claim 26, wherein said coupling lines are spaced from respective ones of said first and second antenna elements by a distance that is a function of a wavelength of one of the first and second frequencies.

28. The antenna of claim 26, wherein said coupling lines have a length that is a function of one of the first and second frequencies.

29. The antenna of claim 1, wherein said plurality of antenna elements are arranged at different pitch angles based on said plurality of different frequency bands.

30. The antenna of claim 25, wherein said plurality of antenna elements are arranged at different pitch angles based on said plurality of different frequency bands.

31. The antenna of claim 26, wherein said first antenna elements and second antenna elements are arranged in parallel at same pitch angle.

32. The antenna of claim 26, wherein said first antenna elements and second antenna elements are arranged at different pitch angles.

* * * * *